United States Patent [19]

Takahashi et al.

[11] Patent Number: 4,583,502

[45] Date of Patent: Apr. 22, 1986

[54] WEAR-RESISTANT MEMBER FOR USE IN AN INTERNAL COMBUSTION ENGINE

[75] Inventors: Kentaro Takahashi; Takeshi Hiraoka; Yoshikatsu Nakamura; Masajiro Takeshita, all of Saitama, Japan

[73] Assignee: Nippon Piston Ring Co., Ltd., Tokyo, Japan

[21] Appl. No.: 122,902

[22] Filed: Feb. 20, 1980

[30] Foreign Application Priority Data

Feb. 26, 1979 [JP] Japan ..... 54-20740

[51] Int. Cl.[4] ..... F01L 3/02

[52] U.S. Cl. ..... 123/90.39; 123/90.51; 123/90.6; 123/188 AA; 75/126 K

[58] Field of Search ..... 123/90.39, 90.51, 188 AA, 123/90.60; 29/156.7 R, 156.7 B, 156.7 A; 75/123 D, 126 K, 128 P

[56] References Cited

U.S. PATENT DOCUMENTS

| | | | |
|---|---|---|---|
| 3,301,240 | 1/1967 | Peresada | 123/90.51 |
| 3,497,347 | 2/1970 | Dautzenberg et al. | 75/126 K |
| 3,683,876 | 8/1972 | Lesher | 123/90.51 |
| 3,925,065 | 12/1975 | Osawa et al. | 123/188 AA |
| 4,230,491 | 10/1980 | Behnke | 123/90.51 |
| 4,243,414 | 1/1981 | Takahashi et al. . | |

FOREIGN PATENT DOCUMENTS

| | | | |
|---|---|---|---|
| 1196865 | 7/1970 | United Kingdom | 123/90.39 |

*Primary Examiner*—W. R. Wolfe

*Attorney, Agent, or Firm*—Sughrue, Mion, Zinn, Macpeak and Seas

[57] ABSTRACT

A wear-resistant member and method for producing the same which member may form a movable member in an internal combustion engine which is subjected to high pressure such as a rocker arm, tappet, cam, valve or valve seat. The member is formed as a combination of a ferrous sintered body and a ferrous base body having a common surface. The sintered body is formed from a compressed powder body disposed in contact with the ferrous base body. The powder body, in a preferred embodiment, consists of 0.5 to 7.0% by weight carbon, 0.1 to 5.0% phosphorus, the balance being iron, and having a porosity of 12 to 20% by volume at least 40% of which is pores having a pore size of not more than 300 μ. The combined powder body and ferrous base body are heated to a temperature higher than the liquid-phase temperature of the powder body but lower than the melting point of the ferrous body to sinter the powder body.

8 Claims, 11 Drawing Figures

WEAR-RESISTANT MEMBER FOR USE IN AN INTERNAL COMBUSTION ENGINE

BACKGROUND OF THE INVENTION

The present invention relates to a wear-resistant member for use in internal combustion engines and a method for producing the same. Such a wear-resistant member is intended for use as a movable member such as for those subjected to high planar pressures such as rocker arms, tappets, camshaft and valve and valve seat.

Recently, there have been requirements for providing lightweight mechanical members thus increasing the efficiency of the engine in which they are employed in accordance with increased requirements for energy-saving and high output in internal combustion engines. Particularly, wear-resistant members are used under severe working conditions so that composite or combination members including different kinds of materials are often used in order to simultaneously provide good wear-resistivity, mechanical strength, and lightness.

According to the conventional techniques for producing such combination member, the technique used for binding together the different materials is of utmost importance. Generally, envelope-molding, brazing and melt-bonding are employed in order to bond a layer of wear-resistant material to a ferrous base member of cast iron or steel. For example U.S. Pat. No. 3,198,182 discloses a tappet produced by melt-bonding and U.S. Pat. No. 2,753,859 discloses a bond method employing infiltration to produce composite sintered material.

In case of bonding a sintered material to a ferrous base member, envelope-molding is employed after sintering. Alternatively, brazing may be conducted after machining the base to predetermined dimension. It is evident that such processes require complicated expensive, and time-consuming manufacturing processes. For envelope-molding, the materials to be used must be specially selected and special techniques are required for its handling. Further, in the case of brazing, excellent bonding strength is not obtainable due to the lack of complete bonding of the material to the base member.

Another technique for bonding has been proposed in Japanese Patent Publication No. 44-6457 in which powders are provided under pressure on the base member and a sinter technique is used. Similarly, in Japanese Patent Publication No. 45-21169, an infiltration material is used. However, these techniques still involve a number of difficulties in their implementation. For example, in case of the second-mention Japanese Patent Publication, the infiltration material, such as copper, does not provide sufficient scuffing resistance.

When a sintered member is applied to a mechanical member subjected to high planar pressure, the porosity of the sintering member should be low in order to adequately withstand the high planar pressure. For this purpose, the sintered may be subjected to coining as described in U.S. Pat. No. 2,673,671. Alternatively, the sintered member may be subjected to hot-compacting. However such techniques still require special skills to manufacture the sintered member. For producing combination members, prior to envelope-molding or brazing, the sintered member must be machined to predetermined dimension to successfully bond the sintered member to the base plate so as to produce combination member.

SUMMARY OF THE INVENTION

It is therefore an object of the present invention to overcome the above-mentioned drawbacks and disadvantages and to provide an improved wear member and an improved method for producing the same.

Another object of the present invention is to provide a wear-resistant member for use in an internal combustion engine and a method for producing the same wherein the member is a combination members including a ferrous base member and a ferrous sintered body.

Still another object of this invention is to provide such a combination member having a high-wear-resistance and mechanical strength as well as high bonding strength between the base member and the sintered body.

Still another object of this invention is to provide a method for producing such a combination member which may be easily and economically manufactured.

According to the present invention, iron powders including 0.5 to 7.0% by weight carbon and 0.1 to 5.0% by weitht phosphorus or ferrous alloy powders are compacted or molded under pressure to produce so called "green compact" to thus produce the wear-resistant portion. The pressingly molded body has a porosity of 12 of 20% by volume, at least 40% of which is pores having a pore size of not more than 300μ. Thereafter, the green compact are positioned on a ferrous base member formed of cast iron or steel having a melting point higher than that of the green compact. The combination material is placed in a sintering furnace and heated to a temperature of no greater than 1,250° C. which is lower than the melting point of the base member but which causes the powders of the compact to enter a liquid-phase state, during which the green compact are sintered while simultaneously diffusion elements contained in the green compact diffuse into the base body to thus promote bonding between the sintering body and the base body. Then, still in the sintering furnace, the combination member is gradually and continuously cooled from its sintering temperature. The resultant combination member has a porosity of 0.2 to 10% by volume with at least 40% of the sintering pores being sintering pores having a pore size of not more than 250μ. A combination member thus produced, in which the sintered body is strongly bonded to the base body, may be employed as a wear-resistant member for use in an internal combustion engine.

DETAILED DESCRIPTION OF THIS INVENTION

Figure 1:
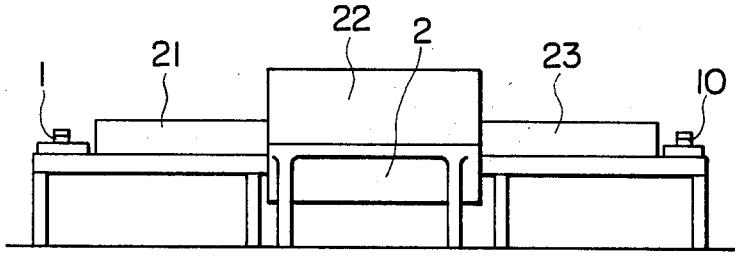
FIG. 1 is a front view showing a sintering furnace employed with a method according to the present invention.
Figure 2:
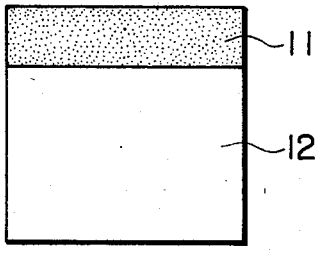
FIG. 2 is a cross-sectional view of a combination member including a pressurized powder body and a ferrous base body according to the present invention.

Referring now to the drawings, and initially to FIGS. 1 and 2, a combination member 1 of the invention has a ferrous base body 12 and a pressurized or compressed powder body 11 mounted thereon. The combination body 1 is placed in a furnace 2 at a reducing pressure successively passing through pre-heating section 21, sintering section 22 and cooling section 23, to thus obtain a final product 10.

The pressurized or compressed powder body 11 shown in FIG. 2 is produced by pressing powders in a die (not shown). According to the present invention, the powders consist of iron powder including 0.5 to 7.0% by weight carbon and 0.1 to 5.0% by weight phosphorus or ferrous alloy powders. Further, the compressed powder body 11 has a porosity of 12 to 20% by volume at least 40% of which is pores having pore size of not more than 300μ.

The pore size and porosity is controlled by the particle diameter of the powders and the compacting pressure applied thereto, the sintering period and sintering temperature so as to provide a final ferrous sintered alloy having the desired porosity of 0.2 to 10% by volume at least 40% of which is sintering pores having pore size not more than 250μ.

Carbon is an effective material for use as a diffusion element for the base body for providing excellent wear-resistivity because of the formation of carbide which is a very hard material. If the amount of carbon is less than 0.5% by weight, the amount of the hardened material is inadequate so that sufficient wear-resistivity is not obtained. On the other hand, if the amount of carbon exceeds 7.0% by weight the bonding surface will be brittle and the hardness of resultant sintered body will be too high so that the opposite mechanical member may be worn by friction. For these reasons the carbon proportion is selected to be within the range 0.5 to 7.0% by weight.

Phosphrus is effective for decreasing the temperature at which sintered body enters its liquid phase without degrading the wear-resistance and mechanical strength of the sintered body. Specifically, the sintered body should enter the liquid phase state at a temperature much lower than the melting point of the ferrous base body, preferably at a temperature of not more than 1,250° C. As a result, density of the sintered body is large and the pore size is small so as to thus enhance the durability of the member against planar pressure. The liquid phase temperature is decreased in proportion to the increase in the amount of phosphorus. In this case if the proportion of phosphrus is less than 0.1%, its desired liquid phase temperature reducing property would not be exhibited. On the other hand, if the amount exceeds 7.0%, the mechanical strength of the sintered body is greatly reduced. Therefore, the proportion of phosphrus is selected from the range 0.1 to 7.0% by weight.

As mentioned, the ferrous base member is formed of cast iron or steel. The base member has a melting point higher than that of the pressurized powder body since it is heated together with the pressurized powder body in the sintering furnace.

The pressurized powder body and the ferrous base body thus prepared are combined together and placed in the sintering furnace. The combination member is thence heated to a temperature higher than the temperature at which the pressurized powder body enters its liquid-phase state. By such heating, the pressurized powder body is liquid-phase sintered during which it greatly contracts and the pore size and porosity decrease. Simultaneously, a diffusion element contained in the pressurized powder body diffuses into the ferrous base body to thereby promote bonding between the two bodies. Subsequent heating and cooling in the furnace provides strong bonding between the powder body and the base body during the cooling process.

Generally, if bonding between the pressurized powder body and the base body is excessively promoted during construction of the powder body during sintering, residual internal stress may result at the bonding surface due to contraction thereby rendering the bonding surface brittle. However, according to the present invention, the disclosed series of heating and cooling steps prevent the generation of internal stress due to contraction so that complete bonding is obtained. The reason for this may be due to the fact that in the sintering furnace, the speeds at which the powder body reaches the sintering temperature, begins contraction, and terminates contraction is significantly higher than the speed at which the diffusion elements diffuse into the base body during heating. Further, during cooling, diffusion is still promoted and is completed.

The preferred composition of the powder mixture according to the present invention includes iron powder including 0.5 to 7.0% by weight carbon powder and 0.1 to 7.0% by weight phosphorus, and/or ferrous alloy. The compressed powder body has a porosity of 12 to 20% by volume, at least 40% of which is pores having a pore size of not more than 300μ.

Preferrably, the compressed powder body contains 0.5 to 7.0% by weight carbon, 0.1 to 5.0% by weight phosphorus, 8.0 to 30.0% by weight chromium and not more than 10% by weight of at least one of Ni, Cu, Co and W with balance being iron. Chromium serves to form chromium-carbide, which has a high hardness, as well as to increase the mechanical strength of the base matrix to thus enhance wear-resistance. If the amount of chromium is less than 8.0%, such desirable characteristics may not be obtained. On the other hand, if the amount is more than 30%, the base matrix will be brittle. At least one of Ni, Cu, Co and W is added in order to increase strength of the base matrix and to increase the wear-resistance because of the accompanying formation of carbide.

More preferrable, the compressed powder body contains 0.5 to 4.0% by weight carbon, 0.2 to 3.0% by weight phosphorus, 10.0 to 20.0% by weight chromium, 0.1 to 2.0% by weight tungsten, and the balance iron. If desired, the compressed powder body may further contain at least one of Ni, Cu and Co. However, the amount of Ni, Cu or Co plus tungsten should be not more than 10% by weight. Tungsten is effective to delay resolution of carbide and is the preferred element for providing sufficient hardness by the carbide in the liquid phase sintering. If the amount of tungsten is less than 0.1% by weight, no such delay function is provided whereas the upper amount should be 2.0% so as to prevent too long a delay.

Such a powder mixture may be produced by a process disclosed in the applicant's U.S. patent application Ser. No. 955,455 (now U.S. Pat. No. 4,243,414). Such sintered alloy provides a pearlite structure, or may provide a bainite and/or martensite structure upon immediate cooling in the sintering furnace. These structures provide a rigid material having high hardness and excellent characteristics for wear resistivity. Particularly, the diffusion bonding function is implemented by the inclusion carbon, phosphorus and chromium as a result of which a member having excellent pitting and scuffing resistances is produced because of the liquid-phase sintering. Moreover, the combination member according to the present invention can be used as a sliding member of wear-resistant sintered alloy suitable for use as a prime mover as disclosed in the above mentioned patent application.

Figure 3A:
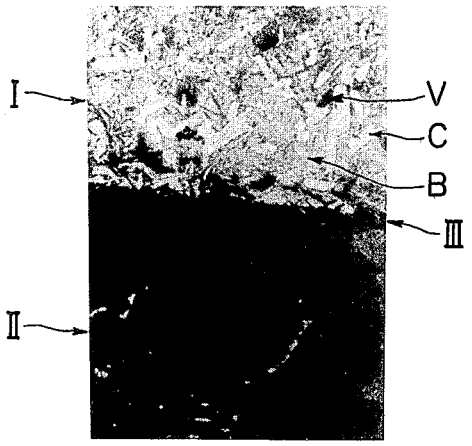
FIG. 3*a* is a microphotograph (magnification of 400) of the structure in the bonding portion between pressurized powder body and base body of a combination member according to the present invention.
Figure 3B:
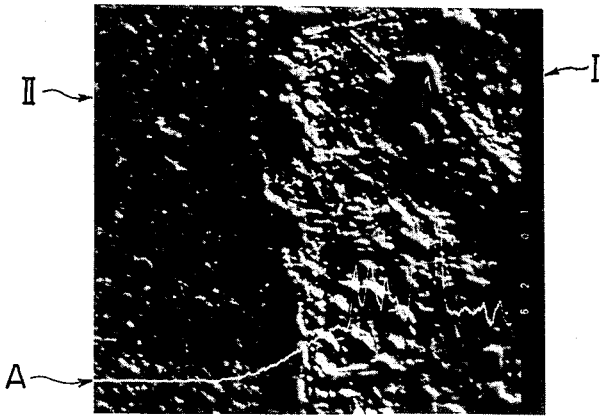
FIG. 3*b* is a X-ray microanalyzer photograph (magnification of 700) of the structure in the bonding portion of a combination member according to the present invention.

A wear-resistant member thus produced for use in an internal combustion engine is shown in FIGS. 3*a* and 3*b*. FIG. 3*a* is a microphotograph (magnification of 400) of the combination member which has been subjected to etching treatment with Marble's reagent. In the photograph, a boundary line III is provided which is defined by close bonding between the base body portion II and the sintered alloy portion I which has excellent wear-resistivity. Pore or voids V, carbides C and raw elements B are dispersed in the sintered alloy portion I.

FIG. 3*b* is an X-ray microanalyzer photograph (magnification of 700) in which chromium of the sintered alloy portion I is diffused into the base body II as shown by a plot A. This diffusion provides strong bonding between the alloy portion I and base body II.

A combination member produced according to the method of this invention and shown in FIGS. 3*a* and 3*b* includes a base body formed of S45C (defined by JIS) and a sintered body containing 2.5 wt % carbon, 12 wt % chromium, 0.5 wt % phosphorus, 1.0 wt % nickel, 1.0 wt % molybdenum, 0.5 wt % tungsten, the balance being iron. The sintered body may be tested in accordance with a technique disclosed in the applicant's above-mentioned application wherein a combination member is subjected to tensile test using Amsler's tester to investigate tensile strength at the boundary portion. A sintered body produced in accordance with the invention was found to have a tensile strength of 20.0 $kg/mm^2$.

A sintered body produced according to the method of the invention has porosity of 0.2 to 10% by volume, at least 40% of which is pores having a pore size of not more than 250μ. When the porosity of the body is less than 0.2% by volume, its lubrication oil retaining property is very poor leading to scuffing wear. On the other hand, when the porosity is more than 10% by volume, the bonding force between particles is weak due to insufficient sintering thus degrading fatigue resistance. Further, the pores are desirably fine and are disposed uniformly. If the porosity is less than 10% by volume and includes mostly pores having a pore size of more than 250μ, the pores will have been locally formed making the oil retainability of the body excessively low. Therefore, the sintered body should have porosity of at least 40% and which contains pores having a pore size of not more than 250μ. The preferred volume and size of the pores is obtained according to the invention by providing a compressed powder body (before sintering having a porosity of 12 to 20% by volume, at least 40% of which is pores having a pore size of not more than 300μ. The porosity and pore size of the sintered body is selected in accordance with whether solid or liquid-phase sintering is used because of the variation of sintering temperature and sintering period.

Figure 4:
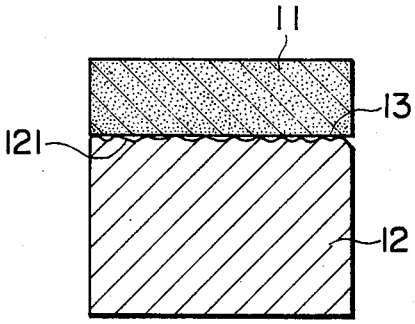
FIGS. 4 through 8 are cross-sectional views showing various embodiments according of a combination member of the present invention.

Preferred embodiments according to the invention will be described with reference to FIGS. 4 through 10. With reference to FIG. 4, it is desirable to render the clearances 13 at an interfacing portion small when the compressed powder body 11 is positioned on the base body 12. Therefore, the base body 12 is machined to provide a surface 121 having a surface roughness of 20μ or less. If the roughness were to exceed 20μ, clearances 13 at the interfacing portion between the powder body 11 and the base body 12 would become large leading to difficulties in diffusing the diffusion-element of the powder body 11 into the base body 12 and resulting in degrading the bonding therebetween.

Figure 5:
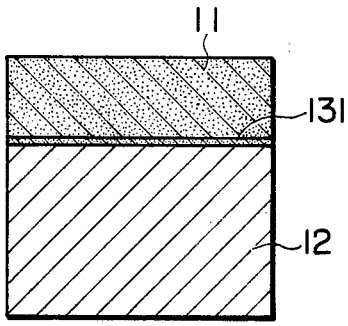

In order to further promote the bonding between 11 and 12, a flux layer 131 consisting of boron or phosphorus is interposed between the compressed powder body 11 and the base body 12 as shown in FIG. 5. The combination body is sintered in the furnace so as to further promote the diffusion effect so as to thereby enhance the bonding force.

Figure 6:
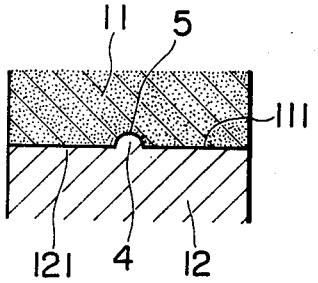
Figure 7:
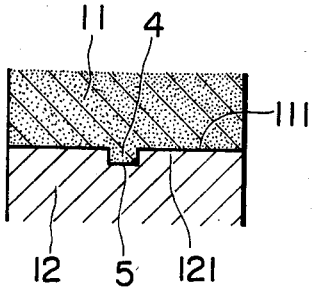
Figure 8:
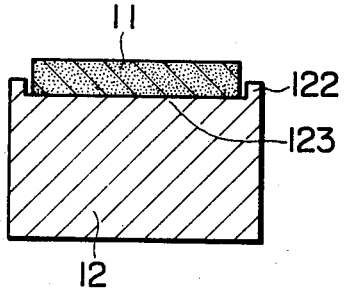

Moreover, in the present invention, since the compressed powder body 11 is merely placed on the base body 12 for the subsequent heating in the furnace, the relative positions of the bodies 11 and 12 should be carefully controlled. In order to alleviate potential positioning problems, as shown in FIGS. 6 to 8, the two bodies are shaped prior to placement of the combination member in the furnace. That is, as shown in FIGS. 6 and 7, a projection 4 and a groove 5 for engagement therewith are formed at the interfacing surfaces 111, 121 of the compressed powder body 11 and the base body 12. Such grooves and projections serve to enable easy positioning between the bodies and to prevent displacement therebetween. Alternatively, as shown in FIG. 8, a recess 123 may be formed at the interfacing surface of the base body 12 for receiving a projecting portion of the compressed powder body therein. The powder body 11 is secured between end flanges 122 of the base body 12.

Figure 9:
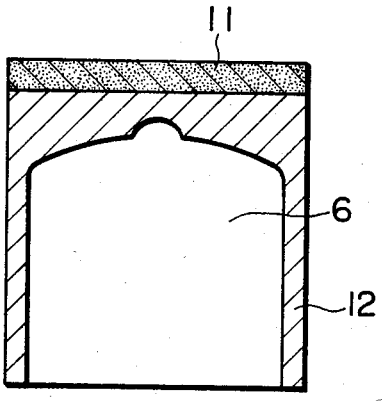
FIGS. 9 and 10 are illustrations showing mechanical members incorporating a combination member of the present invention.
Figure 10:
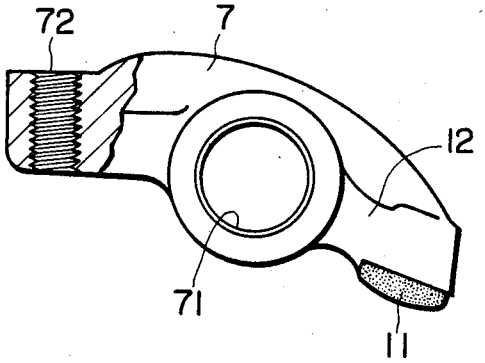

FIGS. 9 and 10 show mechanical members incorporating a combination member of this invention. In FIG. 9, the base body is formed as a tappet 6 having a thin wall. A tappet is required to provide some degree of wear-resistance. To accomplish this, a wear-resistant member formed of sintered body 11 is bonded to a base body 12 of cast iron.

A rocker arm 7 as shown in FIG. 10 must have a light weight and a high toughness. To this effect, a base body 12 is formed of steel to which a wear-resistant member formed of sintered body 11 is bonded by the method of the invention. Further, if desired, a boss portion 71 and a thread seat portion 72, which are required to have a high wear-resistance, may be subjected to a hardening treatment such as carburizing, quenching and nitriding.

The method of the invention employs a ferrous base body so that the sintered body may be bonded thereto by diffusion. The materials of base body and the sintered body are determined as follows. In the case that low-carbon-steel or low-alloy-steel is employed as the base body, the amount of diffusion element contained in the compressed powder body should be relatively large since there is a probability of pores forming adjacent to the interfacing portion of the sintered body caused by diffusion of the diffusion elements in the powder body into the base body.

Still further, in the case that a base body including a relatively large amount of carbon such as cast iron is employed, the melting point of adjacent interfacing portion of the base body is lowered due to mutual diffusion effect between the compressed powder body and the base body so that the bonding portion may be in the molten state. Therefore, the amount of diffusion element contained in the compressed powder element must be controlled accordingly.

It is apparent that a combination member of any shape can be produced by forming the compressed powder body so as to have a desirable interfacing surface capable of providing close surface contact with the interfacing surface of the base body even if the base body has a complex shape. Of course other kind of mechanical members other than those shown in FIGS. 9 and 10 can be formed in accordance with the teachings of the invention.

Yet further, according to the present invention, the structure of the base body is controllable by controlling the cooling speed in the sintering furnace so that the hardness of the body is simultaneously controllable in order to obtain a a sufficient wear-resistivity. In other words, a surfficient wear-resistance is provided by the invention without the use of any special hardening treatment. Therefore, according to the invention, a combination member having a complicated shape may be easily produced with enhanced productivity. A combination member having sufficient wear-resistance and strong bonding force is thus obtainable using a minimized production process.

While the invention has been described in detail and with reference to specific embodiments thereof, it will be apparent to one skilled in the art that various changes and modifications can be made thereto without departing from the spirit and scope of the invention.

What is claimed is:

1. A wear-resistant member for use in an internal combustion engine comprising:

(a) a ferrous sintered body; and (b) a ferrous base body, said ferrous sintered body and said ferrous base body being shaped so as to have a common surface, said sintered body being bonded to said ferrous base body by diffusing diffusion elements of a compressed powder body into said ferrous base body during the sintering of said compressed powder body, said ferrous sintered body being a sintered alloy produced in a liquid-phase state consisting of 0.5 to 7.0% by weight carbon, 0.1 to 5.0% by weight phosphorus, 8.0 to 30.0% by weight chromium, at least one material selected from the group consisting of nickel, copper, cobalt, tungsten, and molybdenum, wherein the combined amount of said nickel, copper, cobalt, tungsten, and molybdenum does not exceed 10% by weight, the balance being iron, and the porosity of said sintered body being in the range of 0.2 to 10% by volume at least 40% of which is pores having a pore size of not more than 250μ.

2. A wear-resistant member as defined in claim 1, wherein said ferrous base body is formed of steel subjected to hardening treatment including at least one of carburizing, quenching and nitriding.

3. A wear-resistant member as defined in claim 1, wherein said ferrous base body is formed of cast iron.

4. A wear-resistant member for use in an internal combustion engine comprising:

(a) a ferrous sintered body; and (b) a ferrous base body, said ferrous sintered body and said ferrous base body being shaped so as to have a common surface, said sintered body being bonded to said ferrous base body by diffusing diffusion elements of a compressed powder body into said ferrous base body during the sintering of said compressed powder body, said ferrous sintered body being a sintered alloy produced in a liquid-phase state consisting of 0.5 to 7.0% by weight carbon, 0.1 to 5.0% by weight phosphorus, 8.0 to 30.0% by weight chromium, at least one material selected from the group consisting of nickel, copper, cobalt, and tungsten, wherein the combined amount of said nickel, copper, cobalt, and tungsten does not exceed 10% by weight, the balance being iron, and the porosity of said sintered body being in the range of 0.2 to 10% by volume at least 40% of which is pores having a pore size of not more than 250μ.

5. A wear-resistant member for use in an internal combustion engine comprising:

(a) a ferrous sintered body; and (b) a ferrous base body, said ferrous sintered body and said ferrous base body being shaped so as to have a common surface, said sintered body being bonded to said ferrous base body by diffusing diffusion elements of a compressed powder body into said ferrous base body during the sintering of said compressed powder body, said ferrous sintered body being a sintered alloy produced in a liquid-phase state consisting of 0.5 to 4.0% by weight carbon, 0.2 to 3.0% by weight phosphorus, 10.0 to 20.0% by weight chrominum, 0.1 to 2.0% by weight tungsten, and the balance being iron, and the porosity of said sintered body being in the range of 0.2 to 10% by volume at least 40% of which is pores having a pore size of not more than 250μ.

6. A wear-resistant member for use in an internal combustion engine comprising:

(a) a ferrous sintered body; and (b) a ferrous base body, said ferrous sintered body and said ferrous base body being shaped so as to have a common surface, said sintered body being bonded to said ferrous base body by diffusing diffusion elements of a compressed powder body into said ferrous base body during the sintering of said compressed powder body, said ferrous sintered body being a sintered alloy produced in a liquid-phase state consisting of 0.5 to 4.0% by weight carbon, 0.2 to 3.0% by weight phosphorus, 10.0 to 20.0% by weight chromium, 0.1 to 2.0% by weight tungsten, at least one material selected from the group consisting of nickel, copper, and cobalt wherein the combined amount of said at least one material plus said tungsten does not exceed 10% by weight, and the balance being iron, and the porosity of said sintered body being in the range of 0.2 to 10% by volume at least 40% of which is pores having a pore size of not more than 250μ.

7. A wear-resistant member as defined in any of claims 4 to 6 wherein said ferrous base body is formed of steel subjected to hardening treatment including at least one of carburizing, quenching and nitriding.

8. A wear-resistant member as defined in any of claims 4 to 6 wherein said ferrous base body is formed of cast iron.

* * * * *